United States Patent [19]

Webster

[11] 4,099,827

[45] Jul. 11, 1978

[54] LATCHING DEVICE

[75] Inventor: Van Keith Webster, Camp Hill, Pa.

[73] Assignee: AMP Incorporated, Harrisburg, Pa.

[21] Appl. No.: 816,042

[22] Filed: Jul. 15, 1977

[51] Int. Cl.[2] ..... H01R 11/02

[52] U.S. Cl. ..... 339/228; 339/226; 339/238

[58] Field of Search ..... 339/224–240, 339/200, 261

[56] References Cited

U.S. PATENT DOCUMENTS

| | | | |
|---|---|---|---|
| 1,820,313 | 8/1931 | Maynard | 339/226 |
| 1,820,429 | 8/1931 | Bohan | 339/238 X |
| 1,877,830 | 9/1932 | Eyrick | 339/228 |
| 1,953,821 | 4/1934 | Rabe | 339/238 X |
| 2,089,718 | 8/1937 | Teitelbaum | 339/237 X |

*Primary Examiner*—Roy Lake
*Assistant Examiner*—E. F. Desmond
*Attorney, Agent, or Firm*—Allan B. Osborne

[57] ABSTRACT

The present invention relates to a device for latching a terminal to a battery post. More specifically, a finger on the free end of the terminal's hoop has several sets of teeth and the channel of the terminal has an opening through which the finger is inserted. Further, the finger has support means so that a pair of pliers may be used to tighten the hoop about the battery post by passing the finger into the opening and latching a set of teeth on the channel member wall.

14 Claims, 4 Drawing Figures

LATCHING DEVICE

BACKGROUND OF THE INVENTION

1. Field of the Invention

This invention relates to a device for latching a terminal to a battery post.

2. The Prior Art

The terminal predominantly used today is a split ring device made of lead with a resilient spring member embedded therein. A nut and bolt passing through outwardly projecting yoke-like arms draw the split ring tight about the post. Generally two wrenches or pairs of pliers are required to tighten and loosen the terminal. U.S. Pat. No. 2,039,669 illustrates such a connector. Generally a specifically designed terminal puller is required to remove the terminal from the post due to corrosion plus a tendency for the massive lead body to take a set in the tighten condition.

SUMMARY OF THE INVENTION

The present invention provides a device for latching a terminal about a battery post by passing a finger having teeth through an opening in the channel member located on the opposite side of the hoop portion. The teeth engage the wall of the opening. The removal of the terminal from the post requires only backing the teeth out of engagement. A pair of pliers is the only tool needed to install and remove the terminal.

DESCRIPTION OF THE PRESENT INVENTION

Figure 1:
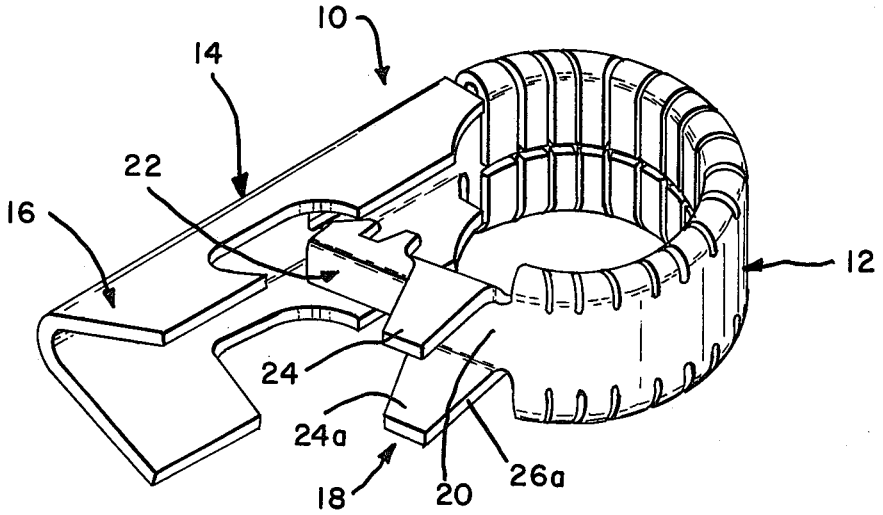
FIG. 1 is a top plan view, partially sectioned, of the battery terminal having the preferred embodiment of the latching device of the present invention.

Battery terminal 10 as shown in the drawings is more fully described in U.S. Application Ser. No. 687,065, filed on May 17, 1976. The terminal shown is universal; i.e., it fits both the positive and negative battery posts (not shown). The major components including the hoop 12, channel 14 and a cable receiving ferrule 16. The hoop is slid down onto the battery post and tightened by reducing the hoop's circumference. One method of tightening the hoop is by providing a stub (not shown) on the free end of the hoop and placing a nut and bolt through the stub and an opening in the channel. The present invention provides another device for tightening and latching the hoop.

Figure 2:
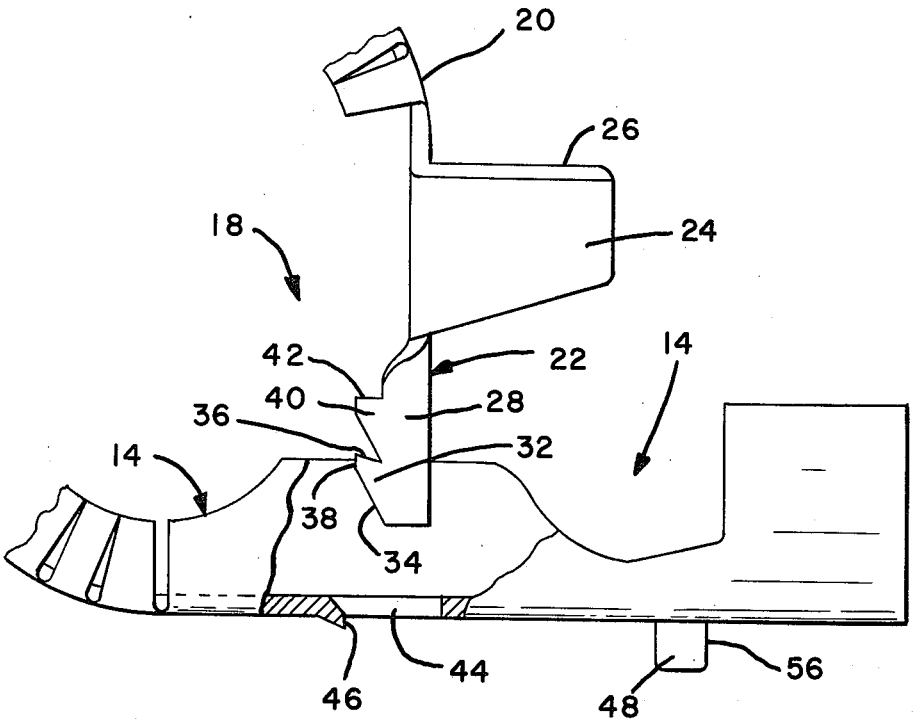
FIG. 2 is a view of the latching device of FIG. 1.

The latching device 18 of the present invention is on the end 20 of the hoop. With reference to FIGS. 1 and 2, latching device 18 includes an elongated finger 22 extending from end 20 of the hoop. Adjacent to end 20, a pair of tabs 24 extend rearwardly from the sides of the finger. These tabs provide upwardly facing shoulders 26. Preferably one tab and its shoulder, herein designated by reference numerals **24*a* and 26*a*, is positioned closer to end 20**; i.e., is offset with respect to the other tab.

Immediately below the tabs, the sides 28 of the finger have been turned forwardly so that the finger is channeled or U-shaped from the base of the tabs to its free end 30.

The forwardly facing edge of sides 28 have two teeth each with the teeth on opposite sides being in alignment with each other to form sets. Thus the finger preferably has two sets of teeth positioned along its U-shaped portion.

The set of teeth next to the finger's free end 30 is indicated by reference numeral 32. The side 34 of the teeth facing the free end; i.e., downwardly facing, is steeply beveled inwardly towards the free end. The opposite side 36; i.e., upwardly facing side of the teeth 32 is also beveled inwardly toward the free end. The angle described by this bevel is shallow, being about 15° relative to a line perpendicular to the finger's longitudinal axis. The crown 38; i.e., the leading edge of the teeth, is flat across.

The uppermost set of teeth, designated by reference numeral 40 also has a downwardly-facing beveled side 34 and a flat crown 38. However its opposing or upwardly facing side 42 is flat relative to a line perpendicular to the finger's longitudinal axis, or in other words, is at right angles to the crown.

Channel 14 contains an opening 44 in its floor. The front edge 46 of the opening has been peened down as shown in FIG. 2. Opening 44 is in general alignment with finger 22.

An ear 48, is located on channel 14 rearwardly from opening 44. The ear projects outwardly from the channel floor as shown and is in preferably alignment with one longitudinal edge of the opening.

As latching device 18 is preferably integral with the battery terminal 10, it is of the same material. One material recommended is tin plated brass.

Figure 3:
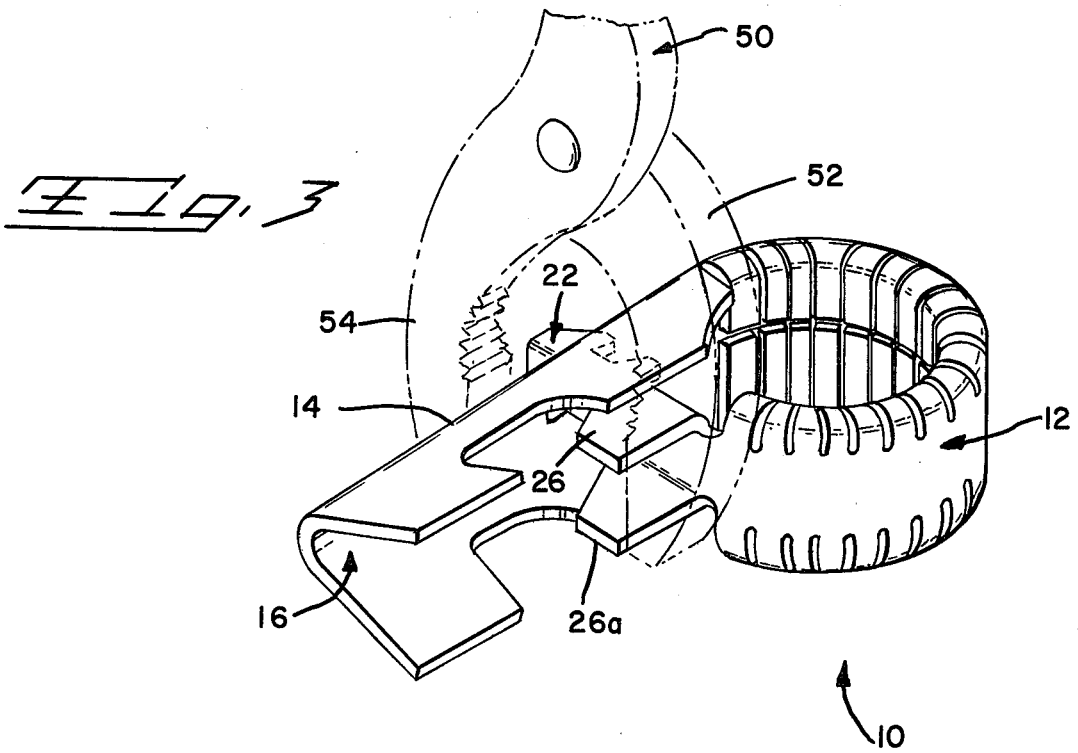
FIGS. 3 and 4 are views illustrating the method of using the latching device of the preferred embodiment.
Figure 4:
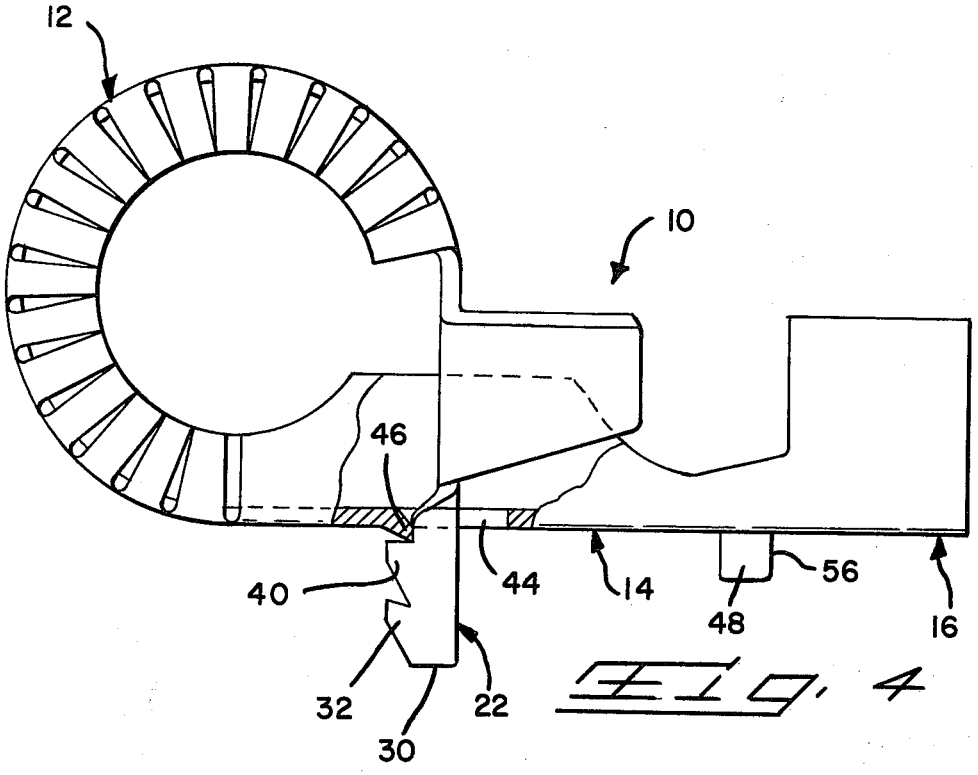

Subsequent to placing terminal 10 onto a battery post (not shown), the hoop 12 is tightened to the post and retained thereon by means of latching device 18. Using pliers 50, one jaw 52 is placed across tab shoulders 26 as shown in FIG. 3. The angle the jaw makes with the shoulders is adjusted for by the aforementioned tab offset. The opposing jaw 54 is placed against the channel 14 immediately behind opening 44. Upon closing the jaws, finger 22 enters opening 44 with the beveled side and flat crown of the teeth sliding across the peened down front edge 46 of the opening. The latching of the finger in the opening occurs upon the upwardly facing side of the teeth being caught underneath the peened down edge 46 of the opening 44. If the battery post is negative; i.e., the largest diameter post, the latching occurs between edge 46 and the upwardly facing side 36 of the lower set of teeth 32. In that the hoop has been closed only partially, the finger 22 is projecting obliquely towards the rear through the opening (not shown). The angle of projection is such that the upwardly facing, beveled side 36 is parallel to the axis of the channel. In the absence of the bevel, the latching on teeth 32 would not be nearly so effective. In the event of a positive post whose diameter is smaller, the hoop is closed more and the finger swings forward so that it is extending through the opening perpendicular to the channel axis. The latching occurs between the edge 46 and the flat, upwardly facing side 42 of the upper set of teeth 40. This condition is shown in FIG. 4.

The terminal 10 may be relased from the battery post by simply pulling back on finger 22; i.e., towards ferrule 16, until teeth clear edge 46. This is accomplished by closing the jaws of pliers 50 on the leading edge of the teeth and the back edge 56 of ear 48. The force in the compressed hoop 12 will withdraw the finger at least partially from the opening. The terminal can then be removed from the battery post.

The foregoing detailed description has been given for clearness of understanding only, and no unnecessary limitations should be understood therefrom, as some modifications will be obvious to those skilled in the art.

What is claimed is:

1. A latching device for a battery terminal of the type having a channel with an opening therethrough and a post-engaging hoop at one end, which comprises:
   a. an elongated finger attached to the free end of the hoop and adapted to be inserted into the opening in the channel;
   b. a plurality of teeth on the free end of the finger, said teeth being adapted to be latched against the wall of the opening to retain the finger therein; and
   c. means on the finger for inserting it into the opening.

2. The latching device of claim 1 wherein the free end of the finger is U-shaped with the teeth extending from the edges of each side.

3. The latching device of claim 1 wherein the teeth have a beveled side facing the free end of the finger.

4. The latching device of claim 3 wherein the teeth adajcent the free end have a relatively shallow beveled side facing away from the free end.

5. The latching device of claim 1 wherein the crown of the teeth is parallel relative to the longitudinal axis of the finger.

6. The latching device of claim 1 wherein the wall of the opening against which the teeth are latched is peened outwardly.

7. The latching device of claim 1 wherein the means on the finger for inserting it into the opening includes a tab attached to and projecting away from the finger.

8. The latching device of claim 7 further including tabs on both sides of the finger.

9. The latching device of claim 8 wherein the tab on one side of the finger is displaced relative to the other tab.

10. The latching device of claim 1 further including an ear extending outwardly from the channel rearwardly of the opening.

11. The latching device for a battery terminal of the type having a channel with an opening therethrough and a post-engaging hoop at one end, which comprises:
   a. an elongated finger extending from the free end of the hoop, and towards the channel with the portion adjacent the free end of the finger being U-shaped and the edges thereof facing forwardly, said finger adapted to be inserted into the opening in the channel;
   b. a first and second set of teeth positioned on the edges of the U-shaped portion, the first set being adjacent the free end of the finger and the second set upwardly therefrom, both sets of teeth having a steeply beveled downwardly facing side and a flat crown relative to the axis of the finger, the first set having a shallowly beveled upwardly facing side and the second set having a flat side relative to a line perpendicular to the axis of the finger, each set of teeth adapted to latch on a wall of the opening as the finger is inserted thereinto; and
   c. a tab projecting rearwardly from each side of the finger, said tabs providing upwardly facing shoulders so that the jaws of a pair of pliers may be placed on the shoulders and on the channel to push the finger into the opening.

12. The latching device of claim 11 wherein one tab is displaced along the finger relative to the other tab.

13. The latching device of claim 11 further including an ear extending outwardly from the channel rearwardly from the opening whereby the jaws of a pair of pliers may be placed on the rearward side of the tab and on the teeth to disengage the teeth from the wall of the opening.

14. The latching device of claim 11 wherein the forward wall of the opening is peened outwardly.

* * * * *